United States Patent [19]

Blewitt

[11] 4,189,694

[45] Feb. 19, 1980

[54] CURRENT LIMITING FUSE WITH IMPROVED LOW CURRENT CLEARING CAPABILITY

[75] Inventor: Donald D. Blewitt, Penn Hills, Pa.

[73] Assignee: Westinghouse Electric Corp., Pittsburgh, Pa.

[21] Appl. No.: 876,393

[22] Filed: Feb. 9, 1978

[51] Int. Cl.[2] ..... H01H 85/04

[52] U.S. Cl. ..... 337/158; 337/161

[58] Field of Search ..... 337/158–165

[56] References Cited

U.S. PATENT DOCUMENTS

| | | | |
|---|---|---|---|
| 2,294,767 | 9/1942 | Williams | 337/161 X |
| 3,243,552 | 3/1966 | Mikulecky | 337/162 |
| 3,287,525 | 11/1966 | Mikulecky | 337/161 |
| 3,304,389 | 2/1967 | Lindell | 337/162 |

*Primary Examiner*—R. L. Moses
*Attorney, Agent, or Firm*—M. J. Moran

[57] ABSTRACT

This concerns a fuse of the type having a central mandrel or fuse spider around which is wound one or more fuse elements. At least one longitudinal strut of the mandrel is disposed to be freely rotated about its axis within limits during a fusing operation. Ideally, spaced struts are disposed to rotate in opposite directions about their axes. The aforementioned fuse element is fixedly secured to the struts so that the opposite rotational movement will strain each fuse element after a fusing operation has begun, thus mechanically breaking those fuse elements in several places to enhance the low current clearing capability of the fuse. An appropriate device for causing the rotation is provided. The device may be driven by an electrically actuated, highly controlled explosive charge which moves a plunger which in turn actuates interlinked levers, thus causing the desired rotation. The foregoing fuse is especially helpful in current limiting operations for high voltage, low current situations.

12 Claims, 11 Drawing Figures

CURRENT LIMITING FUSE WITH IMPROVED LOW CURRENT CLEARING CAPABILITY

BACKGROUND OF THE INVENTION

1. Field of the Invention

The subject matter of this invention relates generally to fuses and more particularly to current limiting fuses of the type utilized for high voltage operation where supplemental mechanical means are utilized for low current clearing.

2. Description of the Prior Art

It has been found that current limiting fuses operate with a relatively greater or poorer degree of ease depending upon two important circuit parameters: circuit voltage and circuit current. The situation involving relatively high voltage, which may be 8.3 kilovolts or larger and relatively low overload current is particularly troublesome. Essentially the foregoing situation exists because the fusible elements usually melt at only one place along the length thereof, but the relatively low current density available after the melting operation has begun is insufficient to burn the fuse elements back fast enough to insert dielectric at a sufficient rate to cause current extinction. In the past, attempts have been made to overcome this problem using such features as special fuse fillers, element support cores constructed of out-gassing materials or combinations of out-gassing and inorganic materials, the use of auxiliary electrodes, snuffer plates, combined expulsion and current limiting fuse sections and so forth. It has been found however that these special features tend to be more successful in the lower voltage ranges than in the higher voltage ranges. Furthermore, in many instances these features introduce greater complexity to the fuse element and therefore increased cost. Also, they tend to limit the interrupting capability of the fuse at higher currents. Examples of appropriate prior art fuse constructions may be found in U.S. Pat. No. 3,256,409 issued June 14, 1966 to T. F. Brandt entitled "Current Limiting Electrical Fuse"; U.S. Pat. No. 3,840,836 issued Oct. 8, 1974 to Link entitled "Current Limiting Sand Fuse"; and U.S. Pat. No. 3,925,745 issued Dec. 9, 1975 to D. D. Blewitt entitled "High Voltage Fuse With Localized Gas Evolving Suppressors." The last-named patent is assigned to the assignee of the present invention. Other patents of interest are: U.S. Pat. No. 2,816,989 issued Dec. 17, 1957 to E. W. Sugden entitled "Electric Fuses"; U.S. Pat. No. 3,949,342 issued Apr. 6, 1976 to F. J. Kozecka entitled "Electric Fuse For Elevated Circuit Voltages"; U.S. Pat. No. 3,743,994 issued July 3, 1973 to Kozecka entitled "Ribbon-Type Fusible Element For High-Voltage Fuses And Fuse Including The Element"; U.S. Pat. No. 4,028,655 issued June 7, 1977 to R. E. Koch entitled "Electrical Current Limiting Fuse With Bound Sand Filler And Improved Low Current Fault Clearing"; U.S. Pat. No. 2,599,646 issued June 10, 1952 to F. J. Kozecka entitled "Current-Limiting Fuse"; and U.S. Pat. No. 3,825,870 issued July 23, 1974 to Y. Ono et al., entitled "Fuse Element And A High Voltage Current-Limiting Fuse." It would be advantageous therefore if a current limiting fuse could be found which operated successfully at relatively high voltage and relatively low overload current, where the fuse was relatively simple and inexpensive and where the interrupting capability at relatively high current was not compromised.

SUMMARY OF THE INVENTION

In accordance with the invention a current limiting fuse is taught for operation at relatively high voltage and low current where the fuse elements are mechanically severed at many places along the length thereof at the initiation of the melting. The result of this is to introduce multiple breaks in the fuse element, each of which sustains a current limiting arc which thus provides dielectric insertion at a rate which is several times more rapid than occurs where there is only one break in the fuse element. This provides an extension of the current and voltage rating of a fuse when other characteristics of the fuse such as fuse length and element size remain unchanged.

BRIEF DESCRIPTION OF THE DRAWINGS

For a better understanding of the invention, reference may be had to the preferred embodiments thereof shown in the accompanying drawings in which.

DESCRIPTION OF THE PREFERRED EMBODIMENTS

Figure 1:
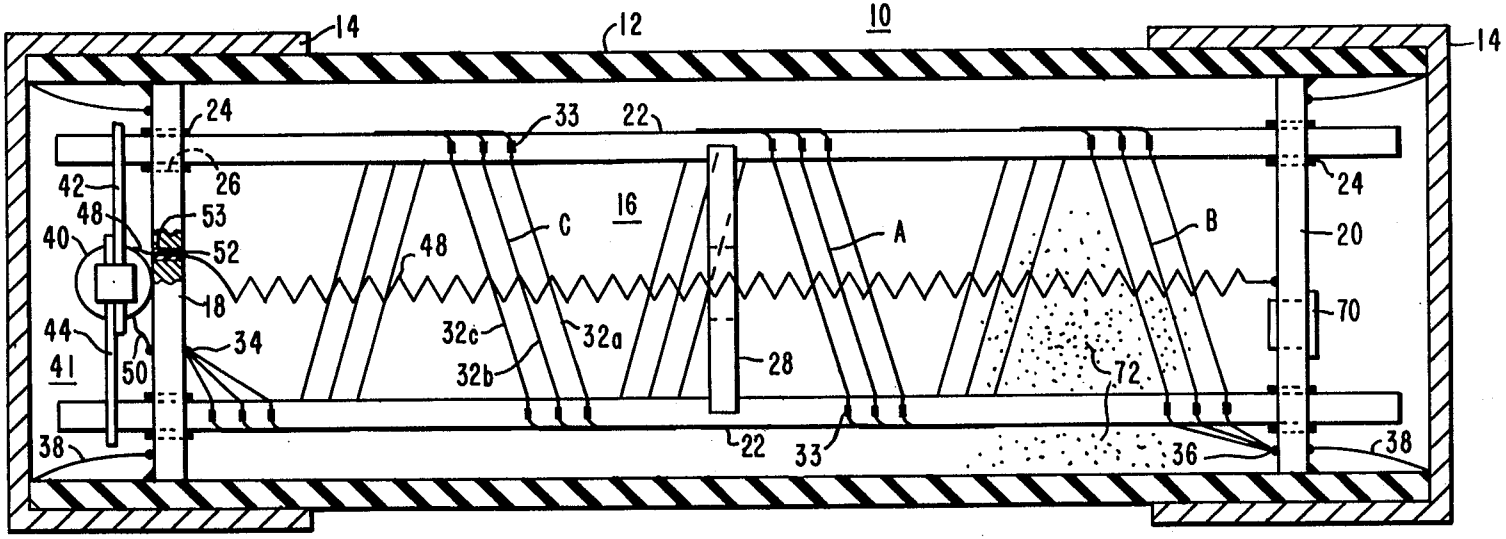
FIG. 1 shows a top partially sectional view of a fuse.
Figure 2:
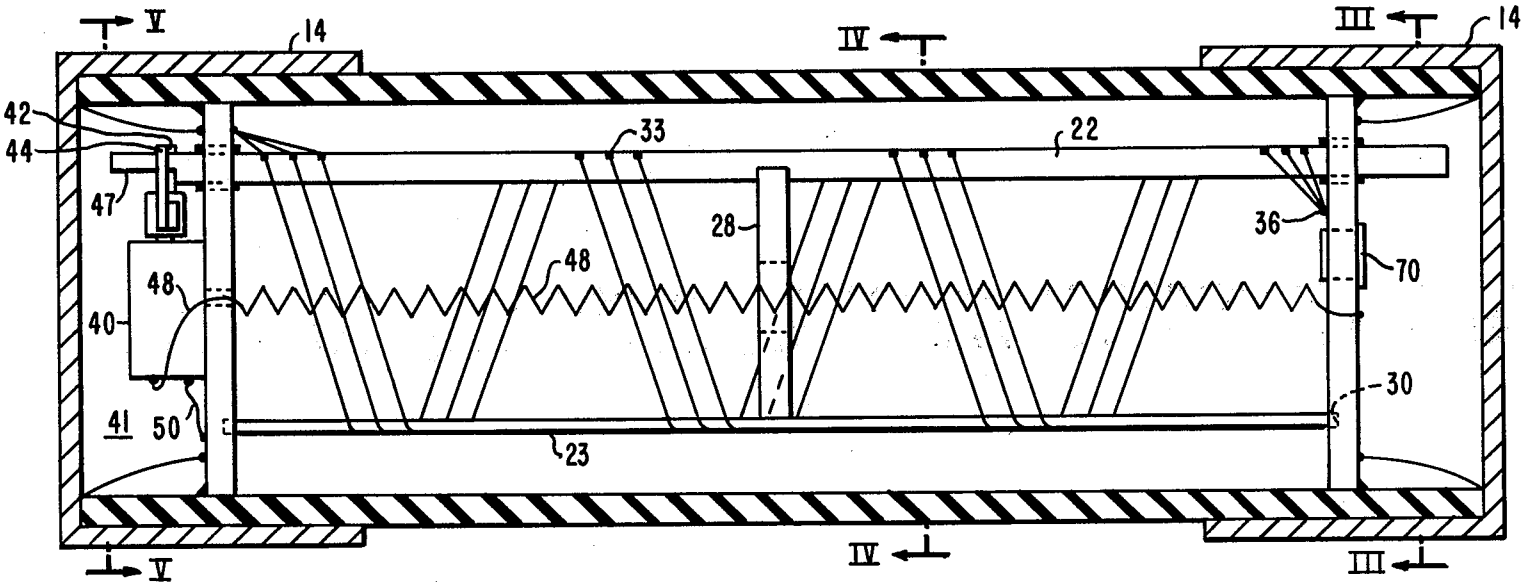
FIG. 2 shows a side elevation of the fuse of FIG. 1 also partially in section.

Referring now to the drawings and FIGS. 1 and 2 in particular, a fuse 10 is shown. Fuse 10 may be a high voltage current limiting fuse. Fuse 10 comprises an elongated tubular housing 12 which typically is made of dielectric or insulating material. Disposed on adjacent ends of the fuse housing 12 are ferrules 14 of electrically conductive material. Ferrules 14 may be disposed upon the fuse body 12 by way of a magnaforming technique. This, however, is not a limiting feature. The fuse 10 comprises in its preferred embodiment an internal mandrel or spider 16. The spider or mandrel 16 may be supported at opposite ends thereof by electrically conducting support plates 18 on the left and 20 on the right as viewed in FIGS. 1 and 2. The support plates may be circular in cross section as is best shown by reference to FIG. 5. The mandrel 16 may comprise two elongated electrically insulating rods 22 which in a preferred embodment of the invention have circular cross sections as may be best seen in FIGS. 3 and 4, for example. Mandrel support members 22 may comprise high strength alumina or glass melamine or the like. As can be best seen by reference to FIG. 2 there may be provided other thinner support rods 23 for the mandrel 16. It can be easily seen that the rods 22 may be significantly thicker or larger in cross sectional area than the mandrel support rods 23. This is not limiting but is advantageous in some embodiments of the invention. In the preferred embodiment of the invention the upper pair of relatively large support rods 22 extend through the end support plates 18 and 20 by way of sandproof bushings 24 which are disposed in openings 26 in the support members 18 and 20. There may be also provided a central support member 28 which may or may not be electrically conductive. In a preferred embodiment of the invention the central support member 28 for the fuse mandrel 16 is made of electrically insulating material. As can be seen by reference to FIG. 2, the relatively thin rods 23 in the preferred embodiment of the invention may comprise ceramic or other insulating material which do not extend through the support plates 18 and 20 but rather are secured within recesses 30 in the end plates 18 and 20. In a preferred embodiment of the invention, single or plural parallel connected fuse wires 32*a*, 32*b* and 32*c* are wound around the fuse mandrel 16. In the preferred embodiment of the invention transverse notches 33 are disposed in appropriate portions of the fuse mandrel rods 22 so that the fuse wires or elements or ribbons 32*a* through 32*c* may be fixedly secured therein. The elements 32*a*, 32*b* and 32*c* may be cemented into the rod slots 33 with a suitable refractory cement such as waterglass-powdered alumina. The fuse wires 32*a*, 32*b* and 32*c* are joined at common junctions 34 and 36 on the electrically conducting end plates 18 and 20, respectively. Jumper wires 38 interconnect the conducting end plates 18 and 20 with the ferrules 14. Consequently it can be seen that a complete electrical circuit exists from the ferrule 14 on the right through the jumper wire 38 on the right, the conducting end plate 20, the junction 36, the parallel fuse wires 32*a*, 32*b* and 32*c*, the junction 34, the electrically conducting end plate 18 on the left, the jumper wire 38 on the left, and the left ferrule 14. The latter path comprises the path of electrical conductivity for the fuse 10. Naturally the fuse wires 32*a*, 32*b* and 32*c* are burnt back or otherwise consumed or interrupted during a fusing operation. In a preferred embodiment of the invention there is provided a movement providing means 40 in a sandproof chamber 41 between the left ferrule 14 and the left mandrel support plate 18. The movement providing means 40 may comprise an explosive indicator type device which is clamped to the end plate 18 for example. This of course is not limiting but preferred. In another embodiment of the invention, for example, the indicator 40 may be disposed in a region to the right of the plate 20 and to the left of the rightmost ferrule 14 as viewed in FIGS. 1 and 2 for example. In still another embodiment of the invention, two coordinated movement providing means 40 may be disposed one in each of the latter-mentioned chambers. In still another embodiment the movement providing means chamber 41 need not be sandproof. In still another embodiment of the invention, the movement providing means 40 may comprise a spring driven rotator mechanism.

Figures 3, 4, 5, 6, 7, 8, 9, 10, 11:
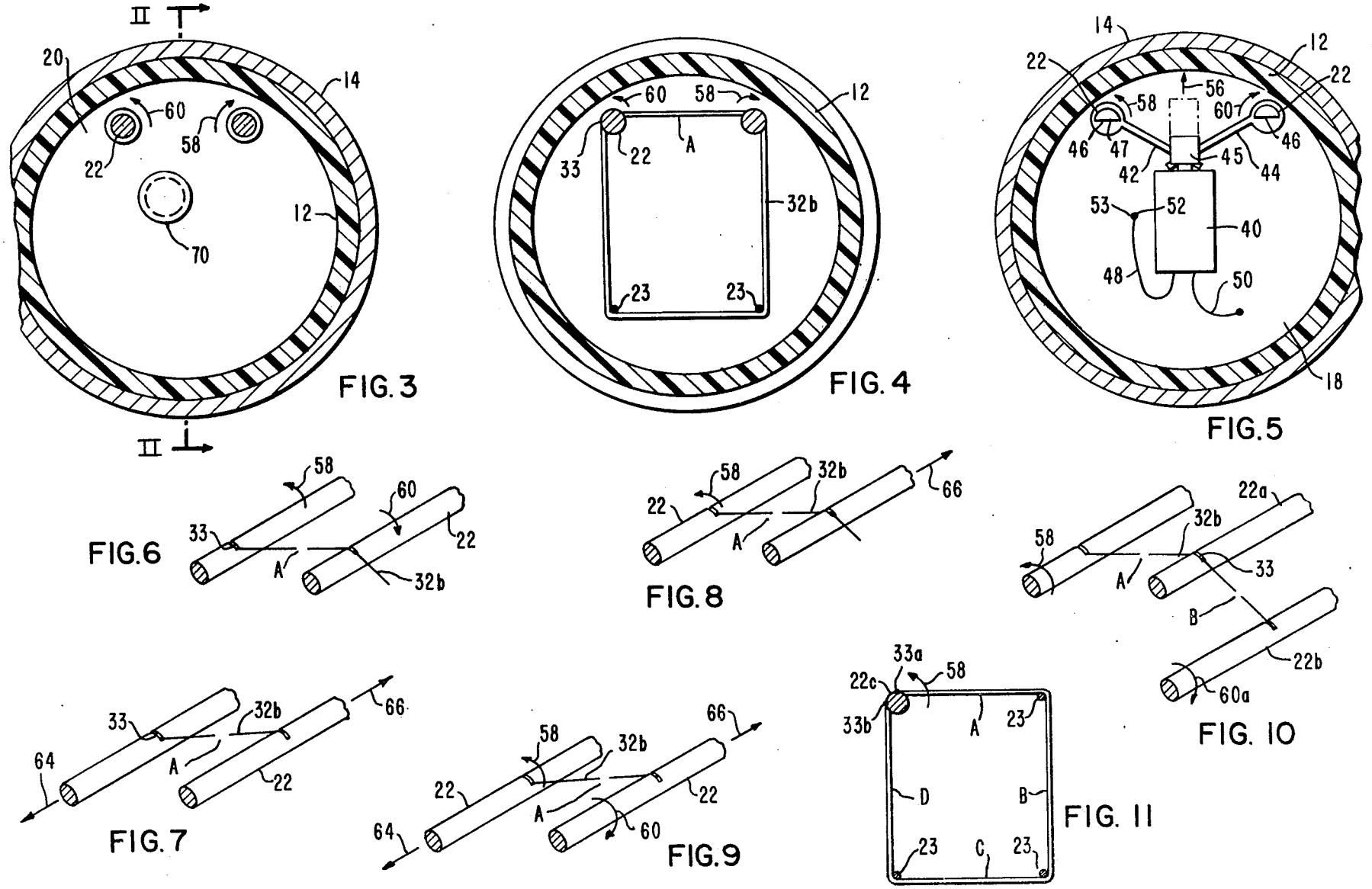
FIG. 3 shows a transverse section of the fuse of FIGS. 1 and 2 at the section lines III—III of FIG. 2, with the latter section partially cut away.
FIG. 4 shows a partial section of the fuse element of FIGS. 1 and 2 at the section lines IV—IV shown in FIG. 2.
FIG. 5 shows a partial section of the fuse of FIGS. 1 and 2 at the section lines V—V of FIG. 2.
FIGS. 6–11 show portions of mandrel strut arrangements partially broken away or in section for various arrangements and modes of movement for mandrel struts with interposed fuse elements.

By referring to FIGS. 1, 2 and 5 the operation of the movement providing means 40 and further construction features thereof is shown. In particular the movement providing means 40 may include oppositely disposed links 42 and 44 which are movably interconnected with a plunger 45. Cutout openings 46 may be provided at the ends of the levers 42 and 44 for keyed interlinkage with the rods 22 at flat regions 47 at the ends of the rods 22. It can be easily seen that this keyed arrangement forces the levers 42 and 44 to rotate in the directions 58 and 60 respectively as the plunger 56 moves upward as viewed in FIG. 5 due to the actuation of the movement device 40. Since the rods 22 are keyed to the levers 42 and 44, they must rotate similarly. A relatively thin electrically conductive actuating wire 48 may extend between an electrical connection on the plate 20 and a sandproof electrically insulating feedthrough bushing 52 on the plate 18. The sandproof bushing 52 may extend through an opening 53 in the plate 18 so that the wire 48 may enter the chamber 41 and be interconnected with one portion of the movement actuating device 40. Another electrically conducting jumper wire 50 may extend between another terminal of the electrically operated movement providing device 40 and the electrically conductive end plate 18. It can be seen then that the wire 48 and its serially connected device 40 are disposed in parallel electric circuit relationship with the fuse wires 32*a*, 32*b* and 32*c*. Generally the relatively small cross section of the wire 48 is insufficient to conduct appreciable amounts of current during the normal non-blown condition for the fuse 10. Consequently, the element 40 will not become energized until significant current begins to flow in the element 48 and this will not occur until all the fuse elements 32, 32*b* and 32*c* initially blow or fuse, thus shifting the overload current to the wire 48.

Referring to FIG. 4 in addition to FIGS. 1 and 2, the wound arrangement for the fuse element 32*b*, in this example, is indicated. The slots 33 and the rods 22 are clearly shown as well as the cooperation between the slot 33 and the fuse wire 32*b*, for example.

By referring to FIG. 3 in addition to FIGS. 1 and 2 the rotating characteristics of the fuse mandrel support rods 22 in directions 58 and 60 is depicted. Further, there is shown a sand fill plug 70 for the plate 20. In a preferred embodiment of the invention, sand 72 or other pulverulent arc quenching material is disposed between the electrically conducting end plate 18 and the electrically conducting end plate 20. After the fuse has been partially constructed, this region is then sealed off by insertion of the plug 70 into the end plate 20.

By referring to FIGS. 1, 2, 3, 4 and 5, operation of the fuse in its preferred embodiment may be best understood. As electrical current from an outside source (not shown) which is interconnected with the fuse 10 by way of ferrules 14, increases, the fuse elements 32*a*, 32*b* and 32*c* begin to conduct increasing amounts thereof. As the fuse elements 32*a* through 32*c* continue to conduct the current, the latter fuse elements begin to increase in temperature. At a relatively low current overload situation, it may take an hour or longer for the fuse elements 32*a* through 32*c* to reach a temperature sufficient to melt the fuse element thus beginning the fusing operation. If the fuse is utilized in a high voltage operation and if the fuse melts initially at only one place, for example A on fuse elements 32*a*, 32*b* and 32*c*, the combination of relatively low overload current and high voltage will cause an arc to be struck between the remaining portions of the fuse elements in the region A. This arc will continue to burn back or consume portions of the fuse elements thus inserting a dielectric into the path of the current through the fuse elements thus tending to limit or reduce the current. Unfortunately if the fuse severs or begins to blow at only one region A, even at relatively low voltage the dielectric insertion caused by a single or unitary arc is often inadequate to provide sufficient current limting or reducing capability. It would be much more desirable to introduce additional serial arcs such as in the regions B and C shown in FIG. 1. This would significantly increase the dielectric characteristic of the current path between the ferrules 14 thus tending to better limit and extinguish the overload current. Unfortunately this is not the typical situation for high voltage, low overload current conditions. Consequently it would be desirous to mechanically supplement the fusing operation by breaking the fuse elements, for example, mechanically at the regions B and C. As the last of the first fuse elements 32*a*, 32*b* or 32*c* opens or melts at region A thus introducing the previously described arc, a significantly larger portion of current traverses the wire 48 thus actuating the movement providing means 40. When this happens the plunger 45 moves rapidly upwardly in direction 56, thus causing rotation of the keyed support mandrel rods 22 in opposite directions 58 and 60. Since the fuse elements 32*a*, 32*b* and 32*c* are cemented of fixed into at least some grooves 33 in the rods 22, these fuse elements will be tensed by the counter rotating fuse rods 22, thus tending to quickly break the fuse elements at regions B and C in addition to region A. When this happens, the desired secondary and tertiary serial arclets are formed, thus significantly increasing the current limiting capability of the fuse 10 as is well known in the art.

Although the counter rotational movement of the rods 22 described previously and best depicted in FIGS. 3, 5 and 6, is preferred, other forms of movement may be provided as shown in FIGS. 7 through 11. In FIG. 7 the movement of the rods 22 is translational in the opposite directions 64 and 66, thus tending to sever the fuse element 32*b* for example in the region A. In FIG. 8 the rod 22 on the right is shown as moving translationally in the direction 66 while the rod 22 on the left is shown moving in the rotational direction 58, thus tending to sever the fuse element 32*b* in the region A. In FIG. 9 the rods 22 rotate in the directions 58 and 60 as shown in FIGS. 5 and 6 for example but additionally translate in directions 64 and 66 as is shown in FIG. 7, thus providing even greater tension on the fuse element 32*b* to cause it to sever in the region A for example. In FIG. 10 the arrangement is such that rotational rods 22 and 22*b* are spaced at opposite corners of the mandrel 16 rather than adjacent as is shown in FIGS. 1, 2 and 5 for example. An interposed non-rotating corner rod 22*a* is provided. In this case rod 22*a* has a groove 33 therein through which the fuse element 32*b* is guided. However, the rod 22*a* has no glue or fixture material therein which secures the fuse element 32*b* thereto. Consequently, as the rods 22 and 22*b* rotate in opposite directions 58 and 60*a*, for example, the fuse element 32*b* may be broken in either or both of two regions A and B, for example. Finally, referring to FIG. 11 a single rod 22*c* is shown along with three relatively smaller rods 23 at the other corners of the fuse mandrel. The fuse element in one section is secured to the rod 22*c* at 33*a* and is non-fixedly secured to the other three relatively small rods 23. Another portion of the fuse element 32*b* is secured to the rod 22*c* at region 33*b*. Consequently if the single rod 22*c* is made to rotate in the direction 58 for example, sufficient tension will be placed upon the fuse element 32*b* to cause it to break or sever in any or all of the regions A, B, C or D. Of course, the direction of movement of the rod 22*c* may be opposite to the direction 58 if that is desired.

It is to be understood with respect to the embodiments of the invention that the utilization of a four-rod mandrel is not limiting. Furthermore, the exact construction features of the rods 22 and 23, for example, are not limiting provided the rods cooperate with each other and with other portions of the fuse to cause or allow mechanical breakage of a fuse at A, B or C for example, or any combination thereof. Of course, it is also to be understood that the presence of the pulverulent arc quenching material 72 is not necessary, although desirable in most cases.

The apparatus taught herein has many advantages. One advantage lies in the fact that a relatively high voltage fuse may be utilized very effectively on a low current circuit clearing operation where auxiliary arclets are introduced into the fusing element by a mechanical operation to effectively significantly improve the current clearing operation of the fuse. Another advantage lies in the fact that the auxiliary devices used to actuate the supplemental fuse element breakage is relatively non-complex. Another advantage lies in the fact that the construction of the fuse is relatively inexpensive. Another advantage lies in the fact that in a high current clearing operation, the auxiliary breakage is merely supplemental as the fuse element tends by nature to fuse at multiple regions.

What I claim as my invention is:

1. A fuse, comprising:

(a) main fuse body means including spaced terminals;

(b) mandrel means disposed within said fuse body means, one portion of said mandrel means being movable relative to another portion of said mandrel means;

(c) fuse element means fixedly disposed upon said mandrel means to said one portion thereof and said another portion thereof, said fuse element means being also disposed in electrical continuity with said spaced terminals to provide electrical continuity therebetween until said fuse element means melts; and (d) movement providing means disposed to cause movement of said one portion of said mandrel means relative to said another portion thereof when said fuse element means melts to provide tension to said fuse element means between said one portion of said mandrel and said another portion thereof to break said fuse element means to provide improved fuse operation.

2. A fuse, comprising:

(a) electrically insulating main fuse body means having spaced electrically conducting terminals disposed thereupon;

(b) a mandrel disposed within said fuse body means, said mandrel having two insulating rods as part thereof, one of said rods being movable within limits relative to the other of said rods;

(c) fuse element means wound around said mandrel and fixedly disposed upon each of said rods, said fuse element means also being disposed in electrically conducting relationship with said spaced terminals to provide electrical continuity therebetween until said fuse element means melts; and (d) movement providing means supported within said fuse body means in a disposition of mechanical interconnection with said one of said rods and electrical disposition with said spaced terminals to cause said one of said rods to move relative to said other of said rods when said fuse element means melts at any place to cause said fuse element means to break between said rods to provide improved fuse operation.

3. The combination as claimed in claim 2 wherein said one of said rods rotates about its axis in response to actuation of said movement providing means to thereby tense said fuse element to cause said fuse element to break.

4. The combination as claimed in claim 2 wherein said one of said rods translates in its axial direction in response to actuation of said movement providing means to thereby tense said fuse element to cause said fuse element to break.

5. A fuse, comprising:

(a) electrically main fuse body means having spaced electrically conducting terminals disposed thereupon;

(b) a mandrel disposed within said fuse body means, said mandrel having two insulating rods as part thereof, one of said rods being movable within limits in a first direction, the other of said rods being movable within limits in a second direction;

(c) fuse element means wound around said mandrel and fixedly disposed upon each of said rods, said fuse element means also being disposed in electrically conducting relationship with said spaced terminals to provide electrical continuity therebetween until said fuse element means melts; and (d) movement providing means supported within said fuse body means in a disposition of mechanical interconnection with both of said rods and in electrical disposition with said spaced terminals to cause both said rods to move relative to the other when said fuse element means melts at any place to cause said fuse element means to break between said rods to provide improved fuse operation.

6. The combination as claimed in claim 5 wherein said rods move generally in opposite directions relative to each other.

7. The combination as claimed in claim 6 wherein said rods rotate.

8. The combination as claimed in claim 6 wherein said rods translate in an axial direction thereof.

9. The combination as claimed in claim 6 wherein one of said rods rotates and the other of said rods translates in an axial direction thereof.

10. A fuse comprising:

(a) main fuse body means including spaced terminals;

(b) mandrel means disposed within said fuse body means, one portion of said mandrel means being movable relative to a stationary portion of said mandrel means;

(c) fuse element means fixedly disposed upon said mandrel means at two places on said one portion thereof, said fuse element means intercepting said stationary portion at an intermediate place along the length of said fuse element means between said two places of fixture, said fuse element means also being disposed in electrical continuity with said spaced terminals to provide electrical continuity therebetween until said fuse element melts; and (d) movement providing means disposed to cause movement of said one portion of said mandrel means when said fuse element melts to provide tension to said fuse element means between said places of fixture to break said fuse element means to provide improved fuse operation.

11. The combination as claimed in claim 10 wherein said movement is rotational.

12. The combination as claimed in claim 10 wherein said movement is translational.

* * * * *